United States Patent [19]

Smith et al.

[11] Patent Number: 4,592,989

[45] Date of Patent: Jun. 3, 1986

[54] TONER COMPOSITIONS CONTAINING COMPLEX IONOPHORIC POLYMERIC MATERIALS

[75] Inventors: Thomas W. Smith, Penfield; David M. Teegarden, Rochester; Kathleen M. McGrane, Rochester; David J. Luca, Rochester, all of N.Y.

[73] Assignee: Xerox Corporation, Stamford, Conn.

[21] Appl. No.: 722,975

[22] Filed: Apr. 12, 1985

[51] Int. Cl.[4] ..... G03G 9/00; G03G 9/08

[52] U.S. Cl. ..... 430/110; 430/120

[58] Field of Search ..... 430/110, 120

[56] References Cited

U.S. PATENT DOCUMENTS

| | | | |
|---|---|---|---|
| 3,431,412 | 3/1969 | Okubo et al. | 250/65 |
| 4,013,572 | 3/1977 | Marsh et al. | 252/62.1 P |
| 4,269,922 | 5/1981 | Lu et al. | 430/126 |
| 4,299,898 | 11/1981 | Williams et al. | 430/110 X |
| 4,323,634 | 4/1982 | Jadwin | 430/110 |
| 4,391,890 | 7/1983 | Lu | 430/110 |
| 4,396,697 | 8/1983 | Ciccarelli et al. | 430/110 X |
| 4,397,935 | 8/1983 | Ciccarelli et al. | 430/110 |
| 4,404,271 | 9/1983 | Kawagishi et al. | 430/110 |
| 4,433,040 | 2/1984 | Nimura et al. | 430/110 X |
| 4,460,672 | 7/1984 | Gruber et al. | 430/110 |
| 4,518,673 | 5/1985 | Noguchi et al. | 430/110 X |
| 4,535,049 | 8/1985 | Honda et al. | 430/110 X |
| 4,537,848 | 8/1985 | Yourd, III et al. | 430/110 |

*Primary Examiner*—John E. Kittle
*Assistant Examiner*—Mukund J. Shah
*Attorney, Agent, or Firm*—E. O. Palazzo

[57] ABSTRACT

Disclosed is an electrostatic toner composition comprised of resin particles, pigment particles, and a complex of a dipolar molecule or salt attached to an ionophoric polymer.

49 Claims, No Drawings

TONER COMPOSITIONS CONTAINING COMPLEX IONOPHORIC POLYMERIC MATERIALS

BACKGROUND OF THE INVENTION

This invention is generally directed to toner compositions and developer compositions, as well as the use of these compositions in electrostatographic imaging systems including color imaging processes. More specifically, the present invention is directed to toner compositions containing therein, as charge enhancing additives, certain ion binding polymers. These additives which are effective in incorporating (binding) salts into dielectric resins can, in conjunction with the bound salt, cause the toner particles to assume a positive or negative triboelectric charge, and further are non-toxic, thermally stable, and desirably homogeneously dispersed. Positive charging toner compositions with the ion binding polymer/salt complexes of the present invention are particularly useful in electrostatographic imaging systems having incorporated therein a Viton ®-coated fuser roll, since the additives involved do not react with the Viton ®, causing undesirable decomposition thereof, which adversely affects image quality. Negatively charged toner compositions comprised of the ion binding polymer/salt charge complexes are particularly useful in colored imaging processes.

Electrostatographic processes, and more specifically the xerographic process, are well known as documented in several prior art references. This process involves development of an electrostatic latent image by applying toner particles to the image to be developed using, for example, cascade development, magnetic brush development, and touchdown development. The toner particles applied can be charged negatively or positively, depending upon the charge deposited on the photoreceptor surface. Thus, for example, when it is desired to develop a negatively charged imaging surface, the toner particles are positively charged usually by incorporating therein certain charge enhancing additives. In contrast, when developing a positively charged imaging surface, the toner particles are negatively charged usually by incorporating therein charge enhancing additives which will cause the toner particles to assume negative charges thereon.

Numerous charge enhancing additives are disclosed in the prior art including those which impart a positive charge to the toner composition. For example, there is disclosed in U.S. Pat. No. 3,893,935 the use of certain quaternary ammonium compounds as charge control agents for electrostatic toner compositions. According to the disclosure of this patent, certain quaternary ammonium compounds when incorporated into toner materials were found to provide a toner composition which exhibited a relatively high uniform and stable toner charge when mixed with a suitable carrier particle. A similar teaching is present in U.S. Pat. No. 4,079,014 with the exception that there is added to the toner composition as a charge control agent a diazo compound.

Additionally, there is disclosed in U.S. Pat. No. 4,298,672 toner compositions with alkylpyidinium compounds as positive charge enhancing additives. According to the disclosure of this patent, there is incorporated into the toner composition in an amount of, for example, up to about 10 percent by weight the charge enhancing additive cetyl pyridinium chloride. Moreover, there is disclosed in U.S. Pat. No. 4,338,390 toner compositions containing as charge enhancing additives various organic sulfate or organic sulfonate compositions. In accordance with the disclosure of this patent there is incorporated into the toner composition, for example, 10 percent by weight of various organic sulfate or sulfonate compounds, including stearyl dimethylphenethyl ammonium para-toluenesulfonate. These additives impart a positive triboelectric charge to the toner resin particles, and further are compatible with Viton ® fuser systems.

Charge enhancing additives which permit toner particles to assume negative charges are also known. There is described, for example, in the prior art negative charge enhancing additives comprised of an ortho-halo phenylcarboxylic acid, and the use of developer compositions with such additives for causing the development of colored images in xerographic imaging systems. Additionally, in U.S. Pat. No. 4,454,214 there is disclosed toner compositions, including magnetic toner compositions and colored toner compositions comprised of a thermally stable tetrafluoroborate charge enhancing additive. Positive charging toner compositions with these additives, especially the additive cetyl pyridinium tetrafluoroborate, are useful in electrostatographic imaging systems having incorporated therein a Viton ® coated fuser roll, since the tetrafluoroborates involved do not react with the Viton ®, causing undesirable decomposition thereof.

While many charge enhancing additives are known, especially those additives which impart a positive charge to the toner resin particles, there continues to be a need for new charge control additives, particularly those additives which are non-toxic, thermally stable, and can be homogeneously dispersed in the toner resin particles. Furthermore, there continues to be a need for new charge enhancing additives which will not interact with Viton ® type fuser rolls, and wherein the resulting toner and developer compositions are humidity insensitive, since it is known that moisture contained in the atmosphere or moisture from other sources can adversely affect the electrical properties of the toner compositions involved. Moreover, while the charge enhancing additives described in the prior art are suitable for their intended purposes, that is for imparting, for example, a positive charge to the toner resin particles, some of these additives are toxic, interact with certain fuser rolls incorporated into the electrostatographic imaging system, are not thermally stable, and cannot desirably be homogeneously dispersed in the toner resin particles. Specifically, for example, it is known that certain prior art charge enhancing additives adversely affect Viton ® fuser rolls, causing a deterioration in the quality of the images developed in electrostatographic copying systems with these rolls. Thus, for example, Viton ® fuser rolls discolor and turn black as well as develop multiple surface cracks when developer compositions with several of the prior art charge enhancing additives contact the Viton ® fuser roll.

An example of one type of Viton ® fuser roll used in electrostatographic copying machines is comprised of a soft roll fabricated from lead oxide and DuPont Viton ® E-430 resin, a vinylidene fluoride, and hexafluoropropylene copolymer. Approximately 15 parts of lead oxide and 100 parts of the Viton ® E-430 are blended together and cured on a roll at elevated temperatures. Apparently the function of the lead oxide is to generate unsaturation by dihydrofluorination and to provide crosslinking sites for binding of release fluid. Excellent image quality has been obtained with such Viton® fuser rolls, however, in some instances there is a toner fuser compatibility problem when charge control agents are contained in the toner mixture. For example, it is believed that certain quaternary ammonium charge control additives, and alkylpyridinium compounds or degradation products thereof react with the Viton® fuser roll. Thus, an alkylpyridinium chloride such as cetyl pyridinium chloride when included in the toner mixture appears to attack the fuser roll resulting in an increased unsaturation in the Viton® which subsequently crosslinks and looses its compliance. As a result, the Viton® fuser turns black and develops multiple surface cracks resulting in image quality deterioration.

Additionally, it is known that many quaternary ammonium salts are thermally unstable, this instability being dependent upon the alkyl substituents and the gegen ion present therein. Most quaternary ammonium salts are susceptible to the Hoffman degradation reaction wherein undesirable noxious amine byproducts are generated. Furthermore, although quaternary ammonium salt charge enhancing additives are dispersable in resinous toner polymers, they are to a large degree insoluble in such polymers, and therefore the bulk of the salt exists in the toner as small crystallites. Accordingly, the charging characteristics of the final toner composition are substantially dependent on the manner in which the toner is prepared, that is, toners prepared by extrusion, roll milling, or Banbury mixing may have different charging characteristics. Additionally, the inhomogeneity of mixtures of toner resins and quaternary ammonium salts can, in certain situations, contribute to poor developer composition aging. This inhomogeneity tends to cause the dispersed quaternary ammonium salts to be transported through the imaging apparatus undesirably contaminating all subsystems including the photoreceptor, the fuser, and the corona wires.

Accordingly, there thus continues to be a need for improved charge enhancing additives for incorporation into toner compositions and developer compositions. Additionally, there continues to be a need for charge enhancing additives which provide a positive or negative triboelectric charge to the toner resin particles depending on, for example, the nature of the host polymer in which the bound salt is dispersed. Also, there continues to be a need for toner and developer compositions which contain charge enhancing additives that are non-toxic, do not adversely affect fuser rolls, and in particular Viton® fuser rolls selected for use in electrostatographic imaging systems, are thermally stable; and wherein the charge enhancing additives are immobile. Additionally, there is a need for charge enhancing additive which can be prepared by a simple direct, economical process, thereby decreasing the cost of the toner compositions generated. Furthermore, there continues to be a need for toner compositions which will rapidly charge new uncharged toner particles which are added to a positively charged toner composition or negatively charged toner compositions. Moreover, there continues to be a need for toner compositions comprised of charge enhancing additives which will allow development of electrostatic latent images, either positively charged or negatively charged, with a wide spectrum of toner resins.

SUMMARY OF THE INVENTION

It is an object of the present invention to provide toner compositions and developer compositions which overcome the above noted disadvantages.

It is a further object of the present invention to provide developer compositions with toner particles and carrier particles, wherein the toner particles are charged positively.

It is yet another object of the present invention to provide developer compositions with toner particles and carrier particles, wherein the toner particles are charged negatively.

In yet another object of the present invention, there are provided toner particles of improved humidity sensitivity, excellent thermal stability, and wherein these compositions are simultaneously with Viton® fuser rolls.

Another object of the present invention is to provide a developer composition with positively charged toner particles, or negatively charged toner particles, carrier particles, and a thermally stable charge enhancing additive comprised of ion binding polymer/salt complex compositions.

It is yet an additional object of the present invention to provide toner compositions which will develop electrostatic latent images with negative charges, or positive charges, on the photoreceptor surface.

In still another object of the present invention, there are provided toner compositions which will electrostatically transfer developed images effectively from a negatively charged photoreceptor surface, or a positively charged photoreceptor surface, to plain bond paper without adversely affecting the quality of the images, which compositions contain therein as charge enhancing additives certain ion binding polymeric compositions.

In yet another object of the present invention, there are provided charge enhancing additives wherein the cation incorporated into the polymer is bound or attached to an ion binding site, that is, where the salt or dipolar molecule is bound at an ionophoric site.

In still a further object of the present invention, there are provided toner compositions of substantially consistent charging characteristics, when prepared by different known methods, including extrusion or Banbury mixing.

In yet another object of the present invention, there are provided developer compositions which possess favorable aging characteristics.

In another important object of the present invention, there are provided toner compositions wherein the triboelectric charging levels thereof can be easily adjusted to different values.

These and other objects of the present invention are accomplished by providing electrostatic toner compositions comprised of a host thermoplastic polymeric resinous material, pigment particles, and a complex of small dipolar molecules or salt bound or attached to an ionophoric polymer. There are also provided in accordance with the present invention developer compositions comprised of pigment particles and a complex of small dipolar molecules or salt bound to an ionophoric polymer. Also, envisioned in accordance with the present invention are developer compositions comprised of toner resin particles, pigment particles, carrier particles, and a complex of small dipolar molecules or salt bound to an ionophoric polymer.

In accordance with one important embodiment of the present invention, the complex material comprised of small dipolar molecules or salts bound or attached to an ionophoric polymer can be suitably selected to enable the attainment of a positive triboelectric charge value on the toner resin particles, or a negative triboelectric charge value on these particles, which values are dependent on the coating composition present on the carrier particles.

A second specific embodiment of the present invention resides in toner compositions and developer compositions, including colored developer compositions, wherein the ionophoric polymer selected is comprised of polymers with sequences of oxyalkylene residues. Specifically, the oxyalkylene residues, particularly oxyethylene residues, are incorporated into polymers in a cyclic manner as in a "crown" residue, as acyclic pendent groups, such as oxyalkylene acrylate monomers, and as linear in chain acyclic sequences which may be helical in nature. These polymers have been found to be effective binding compositions for numerous ionic salts and dipolar organic molecules.

Illustrative examples of ionophoric polymers with oxyalkylene residues, and others include the following general classes:

I. Ionophoric Polymers Containing Cyclic Polyethers

A. Pendant chain polymers of the following formulas wherein X represents a polymeric chain, $R_1$ to $R_{16}$ are independently selected from the group consisting of hydrogen, lower alkyl groups of from 1 to about 6 carbon atoms, aryl, especially phenyl, chlorine, and cyclic alkyl, n is a number of from, for example, about 5 to about 10,000, and m is a number of from, for example, about 1 to about 4.

A. GENERAL STRUCTURE (IONOPHORE PENDANT TO THE POLYMER CHAIN)

I.

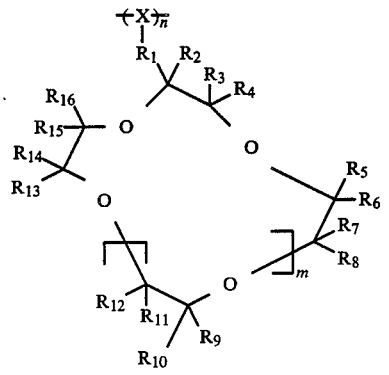

SPECIFIC STRUCTURE, POLY(4'-VINYLBENZO-18-CROWN-6)

-continued

II.

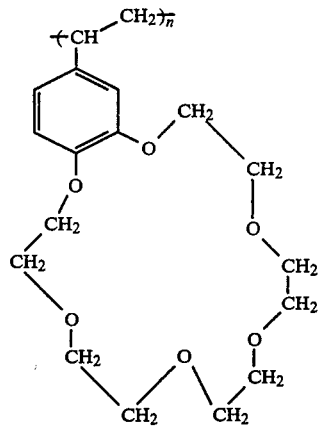

Illustrative examples of polymeric chains as represented by X include various known polymers, providing that the oxyalkylene residues can be appended thereto, such as those derived from acrylic monomers, various vinyl monomers, polyesters, polyamides, polystyrene and derivatives thereof, polybutadiene and its derivatives, and the like. Suitable vinyl resins can be selected from homopolymers or copolymers of two or more vinyl monomers. Vinyl monomeric units include styrene, vinyl naphthalene, ethylenically unsaturated mono-olefins, such as ethylene, propylene butylene, isobutylene and the like; vinyl esters such as vinyl acetate, vinyl propionate, vinyl benzoate, vinyl butyrate, and the like; ethylenically unsaturated diolefins, such as butadiene; isoprene, esters of alphatic monocarboxylic acids such as methylacrylate, ethylacrylate, and butylacrylate, isobutylacrylate, dodecylacrylate, methyl methacrylate, ethyl methacrylate, butyl methacrylate, and the like. These ionophoric polymers can be prepared by attaching the pendent oxyalkylene residues to the monomer selected, followed by polymerization, or alternatively the polymer can be prepared and the oxyalkylene residues can be grafted thereon.

B. Polymers with cyclic polyether residues incorporated in the polymer chain, as illustrated with reference to the following formulas wherein Y represents the non-functional polymeric portion of the chain, $R_1$ to $R_{16}$ are independently selected from the group consisting of hydrogen, lower alkyl groups containing from 1 to about 6 carbon atoms, aryl, especially phenyl chlorine and cyclic alkyl, subject to the provision that at least two of the 16 substituents on the cyclic polyether are represented by X; n is a number representative of the degree of polymerization and can generally be varied between about 5 and 10,000, and m, which designates the size of the cyclic polyether ring, is typically a number of from 1 to about 4.

Examples of X are as indicated herein with respect to the ionophoric polymers of I.A.

B. GENERAL STRUCTURE (IONOPHORE IN THE POLYMER CHAIN)

-continued

III

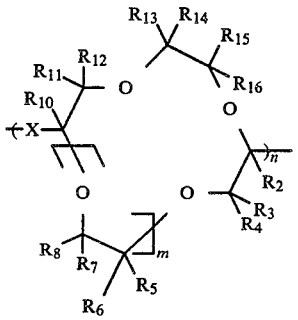

SPECIFIC STRUCTURE

IV

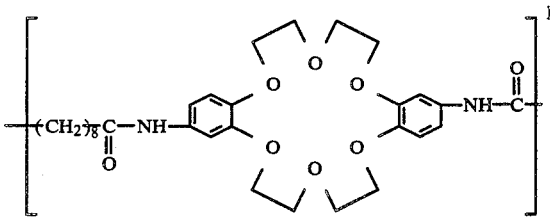

°POLYETHER AMIDE DERIVED FROM THE CONDENSATION OF SEBACOYL CHLORIDE AND 5, 5' DIAMINO DIBENZO-18-CROWN-6

II. Ionophoric Polymers Containing Cyclic or Bicyclic Diaza-Crown Ethers of the Following Formulas, V, VI, and VII; and Wherein X and n are as Defined Herein Most known polymers of this class are similar to those of class IB wherein the ionophoric moiety is part of the polymer chain. Also, mono- and diaza-crowns of formulas VII and IX, wherein the substituents X, n and $R_1$ are as defined herein can, however, be prepared in which the ionophoric moiety is pendent to the polymer chain as in class IA.

IIA AZA CROWN ETHERS (IONOPHORE IN THE POLYMER CHAIN)

V

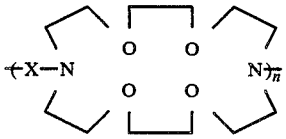

POLYAMIDES, POLYAMINES AND POLYUREAS DERIVED BY POLYMERIZATION THROUGH THE AMINO ATOMS OF THE DIAZER CROWN ETHER ARE MOST PROMINENT POLYMERS OF THIS CLASS

VI

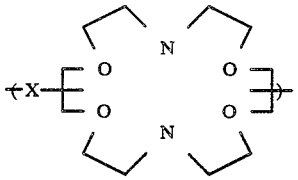

-continued

VII

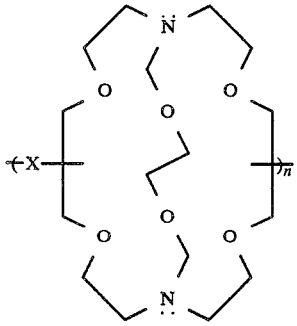

II B. AZA CROWN ETHERS (IONOPHORE PENDANT TO THE POLYMER CHAIN)

VIII

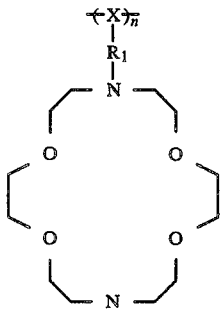

IX

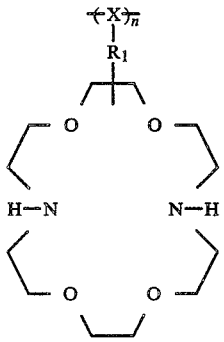

III. Ionophoric Polymers With Pendant Acyclic Polyether Residues

A. Pendant chain polymers of the following formulas and containing linear polyether residues wherein the substituents X, n and $R_1$ and $R_2$ are as defined herein, and the length m of the pendent polyether segment is typically from about 4 to about 100.

III A. ACYCLIC POLYETHERS (IONOPHORE PENDANT TO THE POLYMER CHAIN)

GENERAL

X

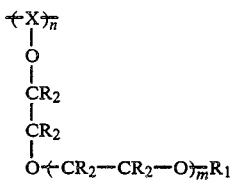

SPECIFIC

-continued

XI

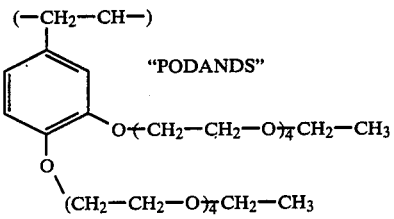

"PODANDS"

XII

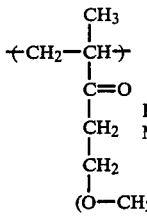

POLY (DECAETHYLENE GLYCOL MONOMETHACRYLATE)

B. Ionophoric polymers with in-chain acyclic polyether segments. Certain polymers of this class are particularly effective ionophores, and may exist in helical conformations, particularly in the ion-bound state. Polymers with linear in-chain sequences of oxyalkylene residues include, for example, styrene-ethylene oxide diblocks and triblocks, poly(cyclo-oxa-alkane)diyls, polyethylene oxides, polypropylene oxides, polystyrene oxides and the like. These polymers are typified by XIII through XVII, as follows, and wherein the substituents are as defined herein.

III B. ACYCLIC POLYETHERS (IONOPHORE IN POLYMER CHAIN)

GENERAL

XIII.

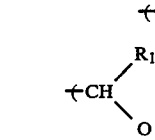

POLYETHER DIBLOCK POLYMER

XIV.

POLYETHERS

α,W-POLY(CYCLO OXALKANE) DIYLS

XV.

SPECIFIC

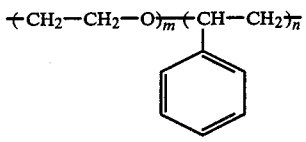

XVI.

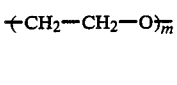

STYRENE/ETHYLENE OXIDE DIBLOCK POLYMERS

XVII.

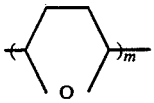

POLYETHYLENE OXIDE 2,5-POLY (TETRAHYDROFURAN) DIYL.

The aforementioned polymers can be complexed with salts by a number of known methods. Thus, for example, the polymer and salt can be dissolved in a common solvent, followed by admixing thereof. Specifically, 100 percent complexation can be achieved by first dissolving about 1 gram of KSCN in about 20 milliliters of methanol, followed by adding this solution to 4 grams of dissolved polymer (poly THF) in about 20 milliliters of methanol. Subsequent to mixing and separation, the polymer complexed (100%) with KSCN is obtained, as determined for example, by Differential Scanning Callorimetry (DSC).

Examples of cations that can be bound and incorporated into the polymers described herein include alkali earth salts, alkaline salts, the transition metal salts, and other similar salts providing the objectives of the present invention are satisfied. Specific examples of cations that can be bound and incorporated into the polymers illustrated herein are alkali earth metals like lithium, sodium, potassium, cesium, and rubidium; alkaline earth metals such as berrylium, calcium, strontium, magnesium, and barium; rare earth metals including Ge, Ga, Er, La, and Pr; while examples of specific transition metals that are useful include titanium, chromium, iron, silver, gold, mercury and the like. Also useful as cations are metals such as zinc, aluminum, and tin. Moreover, as cations, there can be selected ammonium compounds including ammoniums and alkyl ammonium salts of the formula $NH_4^+$, $NHR_3^+$, $NH_2R_2^+$ or $NH_3R^+$ wherein R, $R_2$ and $R_3$ are independent alkyl groups of from 1 to 24 carbons.

These cations are incorporated into the ion binding polymer compositions of the present invention as composite neutral salts. In the composite, the anion of the salt remains in close proximity to the cation. Typical anions include halides such as iodide, chloride, bromide, and fluoride; electronegative anions such as nitrate and perchlorate; organic anions such as citrate, acetate, picrate, tetraphenyl boride; complex anions such as ferricyanide, ferrocyanide, hexachlooanlimonate, hexafluororphosphate, and tetrafluoroborate. The choice of anion can be an important factor in achieving the desired charging characteristics for the toner compositions selected.

While it is not desired to be limited by theory, it is believed that certain cations in view of their size fit well in the polymer matrix, and are selectively bonded to specific ionophoric sites by ion dipole and/or H-bonding forces, while cations such as lithium which are relatively small in their dimensions; or others such as rubidium, which are relatively large in their dimension, may not fit well into a small specific ionophoric site in the polymeric composition; and therefore are attached or held in close proximity to the polymer with, for example, ion dipole forces alone. In ionophoric polymers, large cations are often bound cooperatively between two discrete binding centers.

The cation is bound to the ionophoric polymer in an amount of from about 0.5 percent to about 100 percent depending on the binding capacity of the polymer, and preferably in an amount of from about 1 percent to about 50 percent. Regarding complexes with, for example, oxyalkylene residues, these complexes generally contain a minimum of 4 oxyalkylene residues per binding site. Additionally, the ion binding polymer charge enhancing compositions of the present invention can be incorporated into the toner composition in various desired amounts, providing the objectives of the present invention are achieved. Generally, the charge enhancing compositions are present in the toner in an amount of from about 0.5 percent to about 50 percent by weight, and preferably in an amount of from about 0.1 percent by weight to about 20 percent by weight, for positively charged compositions, and from about 5 percent to about 50 percent by weight for negatively charged compositions.

The ion binding polymers of the present invention, which generally are known compositions, can be prepared by a number of processes described in the literature. For example, the polymers with pendent cyclic or acyclic polyether functionalities, may be prepared by addition polymerization of vinyl or cyclic monomers with pendent cyclic or acyclic polyether groups. Also, analogous polymers can be prepared by polymer derivitization. Polymers with in-chain cyclic polyether residues are generally prepared by polycondensation reactions, while polymers with in-chain acyclic polyether segments are usually prepared by ring opening polymerizations. Moreover, 2,5 poly(tetrahydrofuran)diyl and its cogeners w-poly(cyclo-oxa-alkane)diyls, are prepared by epoxidation and ring expansion of certain alkylene containing polymers. The specific reaction parameters for obtaining the polymers involved are described in the following literature references, the disclosure of each being totally incorporated herein by reference: J. Appl. Polym. Sci, 20, 773 (1976); Ibid., 20, 1665 (1976); Macromolecules, 12, 1638 (1979); Makromol. Chem. Rapid Commun., 2, 161 (1981); JACS, 102 (27), 7981 (1980); J. Polym. Sci., Polym. Chem., 17, 1573 (1979l ); W. Dittmann and K. Hamann, Chemiker, 96, (1972), Nouveau Journal DeChemie, 6 (12), 623 (1982); Macromolecules, 13, 339 (1980); Z. Anal. Chem., 313, 407 (1982); J. Polym. Sci., Polymer Chem. Ed., 21, 855 (1983); Ibid, 21, 3101 (1983); Makromol. Chem., 184, 535 (1983); J. Polym. Sci., Pt. Al, 9, 817 (1974); Macromolecules, 12, 1038 (1979); Macromolecules, 6, 133 (1973); and Pure Appl. Chem., 57, 111 (1979).

Numerous known methods can be selected for preparing the toner and developer compositions of the present invention. Thus, the toner compositions can be prepared by mixing of the polymeric resin, pigment particles, and as charge enhancing additives the ion binding polymeric salt complex compositions of the present invention, or by melt blending the resin and pigment particles coated with the ion binding polymeric charge enhancing additives of the present invention, followed by mechanical attrition. Other processes for preparing the toner compositions of the present invention can be selected including, for example, spray drying and suspension polymerization. The toner resin is generally present in the toner composition in an amount providing a total sum of all toner ingredients equal to about 100 percent, thus when about 100 percent by weight of the ion binding polymeric composition of the present invention is present, about 10 percent by weight of colorant or pigment particles are present, and about 80 percent by weight of the resin is included therein.

Developer compositions of the present invention can be prepared by mixing carrier particles with the toner composition in any suitable combination, however, best results are obtained when about 1 part to about 10 parts of toner composition are mixed with from about 100 parts to about 200 parts by weight of carrier particles.

Various suitable resins may be selected for the toner compositions of the present invention, however, illustrative examples of typical resins include polyamides, epoxies, polyurethanes, vinyl resins, polycarbonates, polyesters, and the like. Any suitable vinyl resin may be selected including homopolymers or copolymers of two or more vinyl monomers. Typical of such vinyl monomeric units include: styrene, vinyl naphthalene, ethylenically unsaturated mono-olefins such as ethylene, propylene, butylene, isobutylene and the like; vinyl esters such as vinyl acetate, vinyl propionate, vinyl benzoate, and vinyl butyrate; ethylenically unsaturated diolefins, like butadiene and isoprene; esters of unsaturated monocarboxylic acids such as methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate and the like; acrylonitrile, methacrylonitrile, vinyl ethers such as vinyl methyl ether, vinyl isobutyl ether, and vinyl ethyl ether; vinyl ketones inclusive of vinyl methyl ketone, vinyl hexyl ketone, and methyl isopropenyl ketone; and mixtures thereof. Also, there may be selected as toner resins various vinyl resins blended with one or more other resins, preferably other vinyl resins, which insure good triboelectric properties and uniform resistance against physical degradation. Furthermore, nonvinyl type thermoplastic resins may also be employed including resin modified phenolformaldehyde resins, oil modified epoxy resins, polyurethane resins, cellulosic resins, polyether resins, polyether resins, and mixtures thereof.

Generally, toner resins with a relatively high percentage of styrene are preferred. The styrene resin may be a homopolymer of styrene or copolymers of styrene with other monomeric groups. Any of the above suitable typical monomeric units may be copolymerized with styrene by addition polymerization. Styrene resins may also be formed by the addition polymerization, including free radical, anionic, and cationic of mixtures of two or more unsaturated monomeric materials with styrene monomer.

Additionally, esterification products of a dicarboxylic acid, and a diol comprising a diphenol may be used as a preferred resin material for the toner compositions of the present invention. These materials are illustrated in U.S. Pat. No. 3,655,374, the disclosure of which is totally incorporated herein by reference, the diphenol reactant being of the formula as shown in Column 4, beginning at line 5 of this patent; and the dicarboxylic acid being of the formula as shown in Column 6. Other preferred polyester materials selected for the polymer toner resin of the present invention include those described in U.S. Pat. No. 4,049,447, and Canadian Pat. No. 1,032,804, the disclosure of each of these patents being totally incorporated herein by reference.

Any suitable known pigment or dye may be selected as the colorant for the toner particles including, for example, carbon black, magnetites, like Mapico black, a mixture of iron oxides, iron oxides, nigrosine dye, chrome yellow, ultramarine blue, duPont oil red, methylene blue chloride, phthalocyanine blue, and mixtures thereof. The pigment or dye should be present in the toner in a quantity sufficient to render it highly colored. For example, where conventional xerographic copies of documents are desired, the toner may comprise a black pigment, such as carbon black, or a black dye such as Amaplast black dye available from National Aniline Products, Inc. Preferably, the pigment is present in amounts of from about 3 percent to about 50 percent by weight based on the total weight of toner, however, if the pigment selected is a dye, substantially smaller quantities, for example, less than 10 percent by weight, may be used.

The absolute value of the triboelectric charge present on the toner particles is preferably from about 10 microcoulombs per gram to about 50 microcoulombs per gram, and more preferably from about 15 microcoulombs per gram to about 35 microcoulombs per gram.

Triboelectric plus or minus charge levels, within this range, may be achieved with the ion binding polymeric charge enhancing additives of the present invention. Triboelectric charge levels outside the ranges specified are also achievable with the complexed ionophoric polymers of the present invention.

While it is not desired to be limited by theory, in accordance with the present invention, the triboelectric charge polarity, that is, a positive or negative polarity can be primarily achieved by the selection of the toner polymer or the polymer used to coat the carrier. Given that these polymers have been appropriately selected, the complexed ionophoric polymers of the present invention can be incorporated into the toner composition, the carrier coating or both the toner and the carrier coating. The magnitude of the aforementioned polarity is affected by the selection of the complexed ionophoric polymer. For example, when the toner is polystyrene, and the carrier is comprised of a steel core coated with a fluoropolymer, the toner resin will acquire a charge with a positive polarity. This charge can be increased dramatically by incorporating an ionophoric polymer such as a diblock polymer of styrene and ethylene oxide into the toner resin. Addition of a small amount of salt such as potassium thiocyanate, which complexes with the oxyethlyene portion of the diblock polymer further increases the positive charge. Additionally, the admixing charging properties, and the rate at which the toner is charged are greatly enhanced when the salt is complexed to the ionophoric polymer.

Included within the scope of the present invention are magnetic toners wherein there is selected as one of the pigments a magnetic substance, such as Mapico black. Accordingly, there can be present in the toner composition as the pigment from about 1 percent by weight to about 6 percent by weight of a colorant, such as carbon black; and from about 10 percent by weight to about 40 percent by weight, and preferably from about 15 percent by weight to about 30 percent by weight of a magnetite, such as Mapico black. Furthermore, the magnetic toner can contain as the exclusive pigment a magnetite, such as Mapico black.

Also included within the present invention are colored toner compositions containing the toner resin particles, carrier particles and the complexed ionophoric polymer charge enhancing additives illustrated herein and as pigments or colorants, magenta, cyan, and/or yellow particles, as well as mixtures thereof. More specifically, with regard to the production of color images utilizing a developer composition containing the charge enhancing additives of the present invention, illustrative examples of magenta materials that may be selected as pigments include, for example, a 2,9-dimethyl-substiuted quinacridone, an anthraquinone dye identified in the color index as Cl 60710, Dispersed Red 15, a diazo dye identified in the color index as Cl 26050, and Cl Solvent Red 19. Illustrative examples of cyan materials that may be used as pigments include copper tetra-4-(octadecyl sulfonamido) phthalocyanine, X-copper phthalocyanine pigment listed in the color index as Cl 64160, Cl Pigment Blue, and identified in the color index as Cl 69810, Special Blue X-2137, and the like; while illustrative examples of yellow pigments that may be selected include diarylide yellow 3,3-dichlorobenzidene acetoacetanilides, a monoazo pigment identified in the color index as Cl 12700, Cl Solvent Yellow 16, a nitrophenyl amine sulfonamide identified in the color index as Foron yellow SE/GLN, Cl dispersed yellow 33, 2,5-dimethoxy-4-sulfonanilide phenylazo-4'-chloro-2,5-dimethoxy aceto-acetanilide, and permanent yellow FGL.

The aforementioned cyan, magenta, and yellow pigments, when utilized with the charge enhancing polymers of the present invention, are generally present in an amount of from about 2 weight percent to about 15 weight percent based on the weight of the toner resin particles.

Various suitable carrier materials are selected for formulating the developer composition of the present invention providing that these carrier particles are capable of triboelectrically obtaining a charge of opposite polarity to that of the toner particles. In one embodiment carriers are selected that will assume a negative polarity permitting the toner particles to adhere to and surround the carrier particles. Examples of these carriers include materials such as glass, steel, nickel, iron ferrites, silicon dioxide and the like, with metallic carriers, especially magnetic carriers being preferred. These carriers can be used with or without a coating, examples of coatings including resins such as polystyrene, homopolymers, copolymers, and terpolymers; polymers of halogen containing ethylenes including vinyl fluorides, vinylidene fluorides, vinyl chlorides, vinylidene chlorides, chlorotrifluoroethylene, a vinyl chloride/chlorotrifluoroethylene copolymer, a vinyl chloride/vinyl acetate copolymer, a chlorotrifluoroethylene polymer, and various known vinyl chloride terpolymers. Coated carrier particles with a diameter of, for example, from about 25 to about 1,000 microns, can be selected providing these particles with sufficient density and inertia to avoid adherence to the electrostatic image during the development process. Many of the typical carriers that can be used are described in U.S. Pat. Nos. 2,618,441; 2,638,522; 3,533,835; and 3,526,533. Also, nickel berry carriers as described in U.S. Pat. Nos. 3,847,604 and 3,767,598 can be selected, these carriers being composed of nodular beads of nickel characterized by surfaces of reoccuring recesses and protrusions providing particles with a relatively large external area. The disclosures of each of the aforementioned patents are totally incorporated herein by reference.

Similarly, a negatively charged toner composition can be obtained when a substance such as a copolymer of ortho/para-chlorostyrene and butadiene containing about 90 percent by weight of chlorostyrene and about 10 percent by weight of butadiene is used as the toner resin in combination with a carrier consisting of a steel core coated with a terpolymer of styrene, methyl methacrylate and a silane monomer. The level of the negative charging can be dramatically enhanced by incorporating, for example, about 25 percent by weight of a polyether acrylate into the carrier coating composition. Also, the negative charging level can be further enhanced by binding a small amount (3 percent) of a salt such as potassium nitrate to the oxyethylene residues of the polyether acrylate. Further, the admixing characteristics of the developer can be improved significantly by incorporating an ion binding polymer such as 2,5-poly(-tetrahydrofuran)diyl containing a large amount (enough to saturate all binding sites in the polymer) of potassium nitrate into the toner resin.

Ionophoric polymers of the present composition can also be used to prepare positive or negative charging toners when the polymer selected as the toner resin and the polymer used as the carrier coating are identical. Thus, with a carrier of, for example, a ferrite core coated with polystyrene, and a toner resin comprised of the same polystyrene, little charge will be developed on the toner. However, when a styrene/ethylene oxide diblock polymer of the present invention is incorporated therein, the toner acquires a significant positive charge when a small amount of potassium nitrate, for example, about 3 percent is bound to the oxyethylene portion of the diblock polymer. The positive charging level can be enhanced, and the charge admixing characteristics of the resulting developer composition could be dramatically improved when the same ionophoric diblock polymer is incorporated into the carrier coating but with a large amount (enough to saturate all the binding sites in the oxyethylene block) of potassium nitrate is bound to the ionophoric polymer. Moreover, when the ionophoric polymer saturated with potassium nitrate is incorporated in the toner, and the same polymer containing less than 3 percent potassium nitrate is incorporated into the carrier coating the toner will charge negatively and will have excellent admixing characteristics.

It is generally accepted that the magnitude of charge exchange between dissimilar materials on contact is related to the relative work functions of the contacting surfaces. The work function of materials in turn may be conveniently determined from Kelvin type contact potential measurements. Accordingly, the charge enhancing characteristics of the ion binding polymers of the present invention and their use in designing developer compositions are perhaps best illustrated by measurements of the contact potential of various composites of these ionophoric polymers (with and without bound salts) with toner resins.

In Table I, the contact potentials of a series of toner type polymers, ion binding polymers, ion binding polymers with bound salt, ion binding polymer/toner polymer composites, and ion binding polymer with bound salt/toner polymer composites are tabulated. These same polymers and polymer composites were coated onto a ferrite carrier core and rolled up against a common toner comprised of a styrene acrylate copolymer containing 6 percent of the low functionality carbon black, Regal 330. The second column of Table I illustrates the maximum tribo levels, in microcoulombs per gram, achieved with the various coated carriers. The data demonstrates the correlation between tribo and contact potential, and further shows that the positive charging characteristics of a coated carrier are significantly enhanced by addition of the ionophoric polymer, poly 2,5(tetrahydrofuran)diyl, (poly "THF"), to the styrene acrylate or polystyrene carrier coatings. Also, this data demonstrates that binding of the salt, KSCN, results in even greater enhancements of the positive charging character.

TABLE I

| Polymer or Polymer Composite | Contact Potential[(b)] | Inverted Tribo[(a)] |
|---|---|---|
| Poly "THF" | +.65 | — |
| Poly "THF".KSCN | +.72 | +17.84 |
| PS (polystyrene) | 0 | +4.17 |
| PS/Poly "THF" | +.50 | +10.84 |
| PS/Poly "THF".KSCN | +.52 | +10.94 |
| Copoly (styrene-n-butyl methacrylate) | +.15 | +5.38 |
| Copoly (styrene-n-butyl methacrylate)/[3] Poly "THF"[4] | +.67 | +7.83 |
| Copoly (styrene-n-butyl methacrylate)/[3] Poly "THF".KSCN[4] | +.68 | +10.35 |

[(a)]Maximum value of carrier tribo, microcoulombs per gram of carrier, ferrite carrier, coated at 0.35 percent by weight with specified polymer or polymer composite, and rolled up against a toner consisting of 6 percent by weight of a low functionality carbon black in a styrene-acrylate resin.
[(b)]Contact potential in volts of a thin film of 1,000 Angstroms coated onto gold. Values are normalized to the PS coated film.
[3] = 90 percent by weight
[4] = 10 percent by weight Positive charging characteristics are best achieved at low bound salt concentrations. At low salt concentrations, most salts push the contact potentials of the ionophoric polymer to higher, more positive values. As more salt is added, the contact potential of the composite will reflect that of the salt itself, thus when the salt has an electronegative gegen ion, the contact potential will move sharply lower at higher bound salt concentrations. This situation is exemplified by the change in contact potential of poly 2,5(tetrahydrofuran)diyl with bound butyl perchlorate TBAP or potassium picrate, reference the data detailed in Table II. Accordingly, also when negative charging composites are desired, higher bound salt levels of salts with electronegative gegen ions should be selected.

TABLE II

| Polymer or Polymer Composite[(a)] | Contact Potential[(b)] |
|---|---|
| Poly "THF" | +.60 |
| Poly "THF".TBAP (1/.03) | +.67 |
| Poly "THF".TBAP $(1/.06)_m$ | +.66 |
| Poly "THF".TBAP $(1/.12)_m$ | +.59 |
| Poly "THF".TBAP $(1/.25)_m$ | +.36 |
| Poly "THF".TBAP $(1/.50)_m$ | +.29 |
| Poly "THF".TBAP $(1/1)_m$ | +.26 |
| Poly "THF".$K^+Pic^-$ $(1/.03)_m$ | +.73 |
| Poly "THF".$K^+Pic^-$ $(1/.06)_m$ | +.64 |
| Poly "THF".$K^+Pic^-$ $(1/.12)_m$ | +.68 |
| Poly "THF".$K^+Pic^-$ $(1/.25)_m$ | +.67 |
| Poly "THF".$K^+Pic^-$ $(1/.50)_m$ | +.48 |
| Poly "THF".$K^+Pic^-$ $(1/1)_m$ | +.20 |
| Poly "THF".$K^+Pic^-$ $(\frac{1}{2})_m$ | +.29 |

TBAP = Tetrabutylammonium Perchlorate
$K^+Pic^-$ = Potassium Picrate
m = molar
[(a)]Mole ratios of Poly "THF" added to salt with molecular weight of Poly "THF" binding site of 6 oxyethylene residues, or 420 Daltons.
[(b)]Contact potential in volts of thin film, less than 1,000 Angstroms on gold.

The toner and developer compositions of the present invention may be used to develop electrostatic latent images on most suitable electrostatic surfaces capable of retaining charge, including conventional photoconductors, like selenium or selenium alloys, wherein a positive charge resides on the photoreceptor; and in processes wherein a negative charge resides on the photoreceptor, which usually occurs with organic photoreceptors. Illustrative examples of organic photoreceptors are dimethylaminobenzylidene; 4-dimethylaminobenzylidene; 2-benzylidene-aminocarbazole, polyvinyl carbazole; (2-nitro-benzylidene)p-bromoaniline; 2,4-diphenyl-quinazoline; 1,2,4-triazine; 1,5-diphenyl-3-methyl pyrazoline 2-(4'-dimethyl-amino phenyl)benzoxazole; 3-amino-carbazole; polyvinylcarbazole-trinitrofluorenone charge transfer complex; phthalocyanines and mixtures thereof.

Additionally, the toner and developer compositions of the present invention can be selected for the development of electrostatic latent images formed on layered photoresponsive devices comprised of a photogenerating layer, and a charge transport layer as described in U.S. Pat. No. 4,265,990, the disclosure of which is totally incorporated herein by reference. Examples of photogenerating layers that may be utilized include trigonal selenium, metal phthalocyanines, metal free phthalocyanines, vanadyl phthalocyanine, and the like, while examples of transport layers include various diamines dispersed in resinous binders, such as those illustrated in U.S. Pat. No. 4,265,990.

In another embodiment of the present invention, the toner and developer compositions described are selected for developing electrostatic latent images formed on a photoresponsive imaging device, followed by transferring the developed images to a suitable substrate, and permanently affixing the image thereto. More specifically, the method of imaging involves the formation of a negatively charged electrostatic latent image on a layered photoresponsive device comprised of a substrate overcoated with a photo-generating layer, which in turn is overcoated with a charge carrier transporting layer, followed by developing the image with the developer composition of the present invention containing the ion binding polymer/salt charge enhancing additive, subsequently transferring the developed image to a suitable substrate such as paper, and permanently affixing the image thereto by heat or other suitable means.

The ion binding polymers of the present invention, with or without salt, effectively determine or set the triboelectric properties of the composite into which they are incorporated. They are also useful in toner compositions pigmented with carbon black and can serve to disperse the carbon black within the toner particle. Further, as the ion binding polymers can dominate (or fix) the charging characteristics of composites in which they are incorporated limitations induced by the inherent charging characteristics of particular pigments can be overcome.

The invention will now be described in detail with respect to specific preferred embodiments thereof, it being understood that these examples are intended to be illustrative only and the invention is not intended to be limited to the materials, conditions or process parameters recited herein. All percentages and parts are by weight unless otherwise indicated.

EXAMPLE I

Poly(tetrahydrofuran 2,5 diyl)

Step 1: Epoxidation of cis-poly(butadiene)

The above polymer was prepared by the epoxidation of cis-poly(butadiene) by analogy to procedures disclosed by W. I. Schultz et al., J. American Chemical Society, 102, 7981 (1980). In a typical procedure, cis-poly(butadiene), 30 grams, was charged into a 2 liter 3-neck flask equipped with gas inlet tube, Teflon® paddle stirrer and thermowell. This polymer was then dissolved in 1 liter of methylene chloride, $CH_2Cl_2$, and a mixture of sodium acetate trihydrate 165 grams (0.12 mole) and peracetic acid, 40 percent, 100 mililiters (0.055 mole) was added dropwise at a rate sufficient to retain the reaction temperature below 30° C. After 5½ hours, the epoxidation was complete as evidenced by NMR analysis. The reaction mixture was then quenched by precipitation of the resulting poly(epoxide) into a dilute methanolic KOH solution at −20° C. The resulting precipitate polymer was subsequently shredded and washed with deionized water. After several washings, the poly(epoxide) was compressed to remove as much water as possible and dissolved in 1 liter of $CH_2Cl_2$. The remaining water was then removed azeotropically.

Step 2: Ring expansion of the poly(epoxide)

Methanol, 165 mililiters was added dropwise to the dry solution of poly(epoxide) in $CH_2Cl_2$, prepared in Step 1 above. This polymer was then ring expanded to form poly(tetrahydrofuran 2,5-diyl) by adding 4 grams of $BF_3$ etherate in 40 milliliters of $CH_2Cl_2$. After 2 hours, an additional quantity of $BF_3$ etherate (1.0 gram in 10 milliliters of $CH_2Cl_2$) was added, and the reaction was extended for another 1.5 hours. The $BF_3$ was then removed by addition of alumina (Woelm, Basic) and filtration. Thereafter, the $CH_2Cl_2$ was exchanged with methanol and the polymer was precipitated into distilled $H_2O$. The precipitated polymer was compressed to remove as much water as possible and was redissolved in benzene, azeotropically dried and freeze dried to yield nearly a quantitative amount of poly(tetrahydrofuran 2,5 diyl).

EXAMPLE II

Poly(2-methyl tetrahydrofuran 2,5 diyl)

The above polymer was prepared by epoxidation of cis-poly(isoprene) in accordance with the procedure detailed in Example I, with the exception that following ring expansion of the epoxide the solvent was exchanged with ethanol prior to precipitation into distilled water. As was the situation in Example I, lophilization from benzene yielded a nearly quantitative amount of poly(2-methyl tetrahydrofuran 2,5 diyl).

EXAMPLE III

Preparation of poly(styrene)-block-poly(isoprene) (50/70) By Weight and (50/100) By Weight Styrene-isoprene block copolymers were synthesized by a two-stage process. In the first stage, living poly(styrene) was synthesized to initiation with sec-butyl lithium in benzene at an initiator level calculated to yield a 50,000, $M_n$, "living" polystyryl anion. The polymerization was carried out at 0° C. for 30 minutes after which time the reaction mixture was held at ambient temperature for 1 hour. The solution of living polymer was then split and isoprene was added to each fraction. In the first instance, an amount of isoprene sufficient to yield an isoprene block segment $M_n$, about 70,000, was added; in the second a larger amount of isoprene sufficient to yield an isoprene block segment of 100,000 $M_n$ was added. In each instance the polymerization was carried out for about 2 hours at 0° C. followed by 19 hours at ambient temperature.

Table I presents the composition, and molecular weight of the obtained diblock polymers,

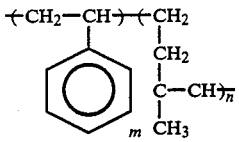

TABLE I

| Sample | % (Polystyrene) Weight | Mole | Experimental | Calc. |
|---|---|---|---|---|
| 3A 50/70 | 37.4 | 32 | 48,300[1]-80,700[2] | 50,000[1]-70,000[2] |
| 3B 50/100 | 33.7 | 27 | 48,300[1]-95,200[2] | 50,000[1]-100,000[2] |

[1]Molecular weight of segment m throughout
[2]Molecular weight of segment n throughout

EXAMPLE IV

Preparation of Poly(styrene)-block-poly(2-methyl tetrahydrofuran 2,5 diyl)diblock polymers The above polymers were prepared by epoxidation of the styrene/isoprene diblock polymers of Examples 3A and 3B. With these block copolymers, epoxidation can be accomplished in either toluene or methylene chloride. The intermediate poly(styrene)-block-poly(epoxide) diblock was precipitated into dilute methanolic KOH as in Example I. Ring expansion was affected in accordance with the procedure of Example I ($CH_2Cl_2$ with $BF_3$ etherate/methanol). The block copolymer 3A results in the poly(styrene)-block-poly(2-methyl tetrahydrofuran 2,5 diyl)diblock designated 4A, and that from 3B yields a similar diblock polymer 4B, with a higher molecular weight polyether segment.

EXAMPLE V

Synthesis of poly(styrene)-block-poly(oxyethylene)

Styrene/ethylene oxide block copolymers were synthesized by a two stage process as described in J. J. O'Malley et al., "Synthesis and Thermal Transition Properties of Styrene/Ethylene Oxide Block Copolymers," in Block Polymers, Plenum Press (1970). In the first stage, living polystyrene was synthesized by adding a THF solution of styrene monomer to a stirred solution of cumyl potassium. This catalyst was prepared in THF from methylcumylether and an Na-K alloy according to the method of Ziegler [Ber., 90, 1107 (1957)]. The polymerization was allowed to proceed for 0.5 hours at 0° C.

Initiation and polymerization of ethylene oxide by living polystyrene comprises the second stage of the reaction. Ethylene oxide was added to the living polymer solution at −78° C. and the red color of the living styryl anion quickly disappeared. The reaction mixture was brought to ambient temperature, and maintained for 24 to 36 hours at this temperature to complete the polymerization of the ethylene oxide. The polymer was then terminated by addition of a drop of glacial acetic acid and isolated by precipitation into hexane.

Table II presents the composition and molecular weight of three diblock polymers prepared in accordance with the aforementioned process, and which can be selected for use in toner composites of the present invention

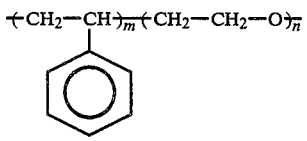

TABLE II

| Sample | % (Polystyrene) Weight | Mole | Experimental | Calc. |
|---|---|---|---|---|
| 5A | 70.0 | 49 | 24,300-10,400 | 20,000-10,000 |
| 5B | 28.2 | 14 | 16,000-40,700 | 20,000-40,000 |
| 5C | 39.3 | 21 | 13,200-20,300 | 10,000-20,000 |

EXAMPLE VI

Copoly(styrene)/methoxy polyethylene glycol 1,000 mono acrylate)

Copolymers of the title description can be conveniently prepared by free radical copolymerization of styrene and methoxy (polyethylene glycol 1,000)monoacrylate, available from Polyscience. In a typical procedure, the two monomers may be conveniently free radially copolymerized with 1 mole percent of benzoyl peroxide in benzene. Thus, 20 grams of monomer (0.036-0.1 moles depending on the monomer ratio) is dissolved in 67 grams of benzene along with 1 mole percent benzoyl peroxide based on the monomer concentration. The reaction mixture is degassed and polymerized under an inert atmosphere at 75° C. for 16 hours. The resulting polymer can then be isolated by reprecipitation and freed of residual monomer to yield the identified copolymer products appropriate for toner formulation.

Table III presents composition and yield data obtained by such a procedure for copolymers of three different polyethylene glycol monoacrylate (PEG) contents,

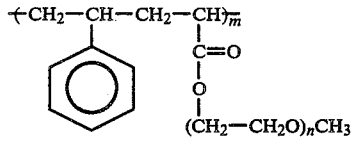

TABLE III

| Sample | Composition Wt. % PEG (in thousands) Experimental | Calc. | Yield |
|---|---|---|---|
| 6A | 10.4 | 10 | 72% |
| 6B | 24.0 | 25 | 20% |
| 6C | 43.0 | 50 | 7% |

EXAMPLE VII

Positive charging toner composition: Carbon black, poly(styrene), poly(styrene-block-poly(oxyethylene)diblock, KSCN This toner composition is conveniently prepared by melt blending 84.6 percent by weight of poly(styrene) (STYRON 686, Dow Chemical) with 6 percent by weight of carbon black (Regal® 330), and 10 percent by weight of the styrene/ethylene oxide diblock polymer as prepared in Example V (5C), complexed with 6 percent by weight, of KSCN based on the oxyethylene component.

The resulting mixture may then be attrited and classified to yield a toner composition which charges positively against several carriers. Thus, for example, when this toner is blended with a carrier consisting of a ferrite core coated with a copolymer derived from fluorovinyl and chlorovinyl monomers (FPC 461, Firestone Plastics), and mixed a positive triboelectric charge in excess of 30 microcoulombs per gram of toner can be achieved.

Positive triboelectric charges can also be achieved when the aforementioned toner is blended with a carrier consisting of a ferrite core coated with a methyl terpolymer comprised of 80.9 percent methylmethacrylate, 14.3 percent styrene, and 4.8 percent vinyltriethoxysilane.

Additionally, positive charging toner composites analogous to that described in this example are obtained by substituting any of the types of polymers illustrated in Examples I through VI for the styrene/ethylene oxide diblock polymer of Example VII and incorporating KSCN at a level of 6 percent by weight based on the oxyethylene component. Further, similar toner compositions can be prepared by the substitution of other salts for KSCN.

EXAMPLE VIII

Positive charging toner composition with enhanced admix characteristics

A toner composition is prepared by melt blending 84 percent by weight of STYRON 686 with 6 percent by weight of Regal® 330 carbon black and 10 percent of the styrene/ethylene oxide diblock polymer of Example VC complexed with 15 percent by weight of KSCN based on the oxyethylene content of the diblock polymer. The triboelectric charging value for this toner is similar to that of the toner of Example VII. Analogous toner composites may be obtained by substituting any of the polymers described in Examples I through VI, for that of Example VIII.

Also, when fresh, uncharged toner is added to a blend of toner and carrier prepared in accordance with Example VIII, the uncharged toner of STYRON 686 will acquire in 60 seconds substantially the same charge as that of the toner particles in the developer since time zero.

EXAMPLE IX

Positive charging magnetic toner composition: poly(styrene), poly(styrene)-clock-poly(oxyethylene)diblock, KSCN This toner composition may be conveniently prepared by melt blending 3 percent by weight of carbon black, Regal® 330, with 22 percent by weight of Mapico Black magnetite, 65 percent by weight of STYRON 686 and 10 percent by weight of the styrene/ethylene oxide diblock polymer of Example V (5C), complexed with 15 percent by weight of KSCN based on the oxyethylene content of the diblock polymer.

When this toner is mixed for several minutes with a carrier comprised of a ferrite core coated with the fluoropolymer FPC 461, the toner will charge strongly positive, in excess of 30 microcoulombs per gram, and will exhibit favorable admix characteristics.

EXAMPLE X

Substantial positive triboelectric charges may also be achieved when the polymer composition of the carrier coating is chemically identical to that of the toner and when the level of bound salt is high in the carrier coating and low in the toner. For example, a toner comprised of 84.6 percent by weight of STYRON 686 with 6 percent by weight of Regal® 330 and 10 percent by weight of a styrene/ethylene oxide diblock polymer complexed with 3 percent by weight of $KNO_3$ will charge strongly positive against a ferrite carrier core coated with 0.5 percent by weight of a composite of a high molecular weight greater than 50,000 number average $M_n$ molecular weight, 90 percent by weight poly(styrene), and 10 percent by weight of a poly(styrene)-block-poly(oxyethylene)diblock complexed with 25 percent by weight, based on the oxyethylene of $KNO_3$ content.

EXAMPLE XI

Magenta colored positive charging toner composition with quinacridone magenta pigment (Hostaperm Pink), copoly(styrene/butadiene) (10/90) by weight, poly(tetrahydrofuran 2,5 diyl), KSCN This toner composition may be conveniently prepared by melt blending 80 percent of Pliolite®, a styrene butadiene resin, with 10 percent by weight of Hostaperm Pink and 10 percent by weight of poly(tetrahydrofuran 2,5 diyl) complexed with KSCN at 4 mole percent based on the concentration of tetrahydrofuran units. The mixture may then be attrited and classified to yield a toner composition which charges positively against several selected carriers. For example, when this toner is blended with a carrier consisting of a ferrite core coated with the fluoropolymer FPC 461, and 10 percent Vulcan (carbon black) positively charged toner particles with a Q/D for 10 micron particles of 3.0 fentocoulombs per micron are obtained.

Positive triboelectric charging values can also be achieved when the above described toner is blended with a carrier consisting of a ferrite core coated with a methyl terpolymer comprised of 80.9 percent methylmethacrylate, 14.3 percent styrene and 4.8 percent vinyl triethoxysilane with 20 percent Vulcan. In this instance, a $Q/D_{10}$ of the order of 0.70 fentocoulombs per micron is obtained.

Further, positive charging toner composites analogous to that described in this example may be obtained by substituting any of the types of polymers illustrated in Examples I through VI for the poly(tetrahydrofuran 2,5-diyl), and incorporating KSCN at a level near 4 mole percent based on the oxyethylene component.

Cyan and yellow toners with similar charging characteristics are obtained when cyan or yellow pigments such as copper phthalocyanine or permanent yellow FGL are substituted for the Hostaperm Pink in the above toner formulation.

Also, colored toner compositions with enhanced admix are obtained when the level of bound salt is increased to 15 percent by weight of KSCN based on the oxyethylene content of the ion-binding polymer.

EXAMPLE XII

Negative charging toner composition: carbon black, poly(styrene), poly(styrene)-block-poly(oxyethylene), $KNO_3$ This toner composition may be conveniently prepared by melt blending 84.6 percent of poly(styrene), STYRON 686, with 6 percent by weight of Regal® 330 and 10 percent by weight of a styrene/ethylene oxide diblock polymer, as prepared in Example V (5C) complexed with 25 percent by weight of $KNO_3$ based on the oxyethylene content of the composite.

The resulting mixture may then be attrited and classified to yield a toner composition which charges negatively against carrier cores coated with selected polymer composites. For example, a negative triboelectric charging value is achieved when this toner is blended with a carrier consisting of a ferrite core coated to 0.5 percent by weight with a 90 percent mixture of poly(styrene), STYRON 686, and 10 percent of a styrene-/ethylene oxide diblock polymer complex with 3 percent by weight of $KNO_3$ based on oxyethylene content.

Other carrier coatings which will yield a negatively charged toner are: 90 percent methylterpolymer, 10 percent poly(styrene)-block-poly(oxyethylene) complexed with 3 percent $KNO_3$; poly(styrene-block-poly(oxyethylene) (70/30) by weight (Example 5A ) complexed with 3 percent by weight of $KNO_3$ based on the oxyethylene content; 90 percent poly(methylmethacrylate), 10 percent poly(tetrahydrofuran) complexed with 3 percent by weight of $KNO_3$ based on oxyethylene content.

EXAMPLE XIII

Negative charging colored toner composition with Quinacridone Magenta Dye (Hostaperm Pink), poly(styrene), poly(styrene)-block-polyoxyethylene, $KNO_3$ The toner of this example is totally analogous to the toner of Example XII except that carbon black has been replaced with the above magenta pigment, with substantially similar results begin achievable. As in Example XI, analogous cyan and yellow toners are obtained when cyan or yellow pigments such as copper phthalocyanine or permanent yellow FGL are substituted for Hostaperm Pink.

Other modifications of the present invention may occur to those skilled in the art based upon a reading of the present disclosure and these modifications are intended to be included within the scope of the present invention.

We claim:

1. An electrostatic toner composition comprised of resin particles, pigment particles, and a complex of a dipolar molecule or salt attached to an ionophoric polymer.

2. A toner composition in accordance with claim 1, wherein the resin particles are comprised of polystyrene.

3. A toner composition in accordance with claim 1, wherein the resin particles are selected from the group consisting of styrene methacrylate copolymers, styrene acrylate copolymers, styrene butadiene copolymers and polyesters.

4. A toner composition in accordance with claim 1, wherein the pigment particles are carbon black.

5. A toner composition in accordance with claim 1, wherein the complexed ionophoric polymer is present in an amount of from about 0.5 percent by weight to about 50 percent by weight.

6. A toner composition in accordance with claim 1, wherein the complexed ionophoric polymer is present in an amount of from about 0.1 percent by weight to about 20 percent by weight.

7. A toner composition in accordance with claim 1, wherein the cation of the salt selected is an alkali earth metal, an alkaline earth metal, a transition metal, or a rare earth metal.

8. A toner composition in accordance with claim 7, wherein the alkali earth metal is lithium, sodium, potassium, cesium, or rubidium.

9. A toner composition in accordance with claim 7, wherein the alkaline earth metal is magnesium, strontium, or calcium.

10. A toner composition in accordance with claim 7, wherein the transition metal is titanium, chromium, iron, silver, gold, or mercury.

11. A toner composition in accordance with claim 1, wherein the anion of the salt selected is a halide, a nitrate, perchloride, thiocyanate, picrate, tetraphenylbromide, $BF_4$-, $SbF_6$-, $SbCl_6$-, or $PF_6$-.

12. A toner composition in accordance with claim 1, wherein the salt selected is sodium chloride, potassium chloride, ammonium chloride, zinc chloride, magnesium chloride, aluminum nitrate or silver nitrate.

13. A toner composition in accordance with claim 1, wherein the complexed ionophoric polymer is a carbon chain polymer with a pendent "crown" ether group.

14. A toner composition in accordance with claim 1, wherein the complexed ionophoric polymer is a copolymer of styrene and 4'-vinyl benzo 18'crown -6.

15. A toner composition in accordance with claim 1, wherein the complexed ionophoric polymer is a condensation polymer bearing an in-chain cyclic polyether, diaza polyether, or aza polyether group.

16. A toner composition in accordance with claim 1, wherein the complexed ionophoric polymer is an open chain polyether.

17. A toner composition in accordance with claim 1, wherein the complexed ionophoric polymer is a polystyrene-block-polyoxyethylene diblock polymer.

18. A toner composition in accordance with claim 1, wherein the pigment particles are comprised of magnetite particles.

19. A toner composition in accordance with claim 1, wherein the pigment is comprised of cyan, magenta, or yellow particles.

20. A developer composition comprised of the toner composition of claim 1, and carrier particles.

21. A developer composition in accordance with claim 20, wherein the carrier particles are comprised of ferrite, steel, glass, sand or nickel berry.

22. A developer composition in accordance with claim 20, wherein the carrier particles are coated with a polymeric coating.

23. A developer composition in accordance with claim 20, wherein the carrier particles consist of a steel core or a ferrite core coated with a polyvinylidene fluoride resin.

24. A developer composition in accordance with claim 20, wherein the carrier particles contain a coating thereover selected from polystyrene homopolymers, copolymers, or terpolymers of halogen containing ethylenes selected from the group consisting of vinylfluorides, vinylidene fluorides, vinylchlorides, vinylidene chlorides and chlorotrifluoroethanes.

25. A developer composition in accordance with claim 20 wherein the carrier particles contain a coating of a complexed ionophoric polymer.

26. A developer composition in accordance with claim 20, wherein the toner particles are of a positive polarity.

27. A developer composition in accordance with claim 20 wherein the toner particles are of a negative polarity.

28. A developer composition in accordance with claim 26, wherein the positive polarity is from about 5 microcoulombs per gram to about 50 microcoulombs per gram.

29. A developer composition in accordance with claim 27 wherein the negative polarity is from about 5 microcoulombs per gram to about 50 microcoulombs per gram.

30. A method for developing latent electrostatic images which comprises providing a negatively charged photoresponsive imaging member, or a positively charge photoresponsive imaging member, contacting the member with the developer composition of claim 20 followed by subsequently transferring the developed image to a suitable substrate and optionally affixing the image thereto.

31. A method of imaging in accordance with claim 30, wherein the imaging member is charged positively and there is selected as a charge enhancing additive a styrene phylene oxide diblock polymer complexed with 25 percent by weight of potassium nitrate, 10 to 20 percent by weight, based on the oxyethylene content.

32. A method of imaging in accordance with claim 30, wherein the photoresponsive imaging member is charged negatively and there is selected as the charge enhancing additive a styrene ethylene oxide diblock polymer complexed with 15 percent by weight of KSCN based on the oxyethylene content; a (styrene/-methoxy polyethylene glycol 1,000 monoacrylate) copolymer complexed with 15 percent by weight based on the oxyethylene content of potassium tetraphenylborie; a poly(styrene/2-methyltetrahydrofuran 2,5 diyl)diblock polymer complexed with KSCN at 15 percent by weight based on the oxyethylene content; a poly(tetrahydrofuran 2,5 diyl) complexed with KSCN at 15 percent by weight; or a (styrene/4'vinylbenzo-18-crown-6) copolymer complexed with 25 mole percent KCl based on the "crown" residues in the polymer.

33. A developer composition in accordance with claim 20, wherein the pigment particles are carbon black or magnetite.

34. A developer composition in accordance with claim 20, wherein the resinous binder is a polystyrene composition.

35. A developer composition in accordance with claim 20, wherein the resinous particles are styrene methacrylate copolymers, styrene acrylate copolymers, styrene butadiene copolymers, or polyester compositions.

36. A developer composition in accordance with claim 20, wherein the resinous particles are styrene n-butylmethacrylate copolymers, containing from about 58 percent by weight to 65 percent by weight of styrene.

37. A developer composition in accordance with claim 20, wherein the complexed ionophoric polymer is a (styrene/ethylene oxide)diblock polymer.

38. A developer composition in accordance with claim 20, wherein the complexed ionophoric polymer is a (styrene/2-methyl tetrahydrofuran 2,5 diyl)diblock polymer.

39. A developer composition in accordance with claim 20, wherein the complexed ionophoric polymer is poly(tetrahydrofuran 2,5 diyl).

40. A developer composition in accordance with claim 20, wherein the complexed ionophoric polymer is poly(2-methyltetrahydrofuan 2,5 diyl).

41. A method for developing latent electrostatic images in accordance with claim 30, wherein the complexed ionophoric polymer is a (styrene/ethylene oxide)diblock polymer.

42. A method for developing latent electrostatic images in accordance with claim 30, wherein the complexed ionophoric polymer is a (styrene/polyethylene glycol monoacrylate) copolymer.

43. A method for developing latent electrostatic images in accordance with claim 30, wherein the complexed ionophoric polymer is a (styrene/2-methyltetrahydrofuran 2,5 diyl)diblock polymer.

44. A method for developing latent electrostatic images in accordance with claim 30, wherein the complexed ionophoric polymer is poly(tetrahydrofuran 2,5 diyl).

45. A method for developing latent electrostatic images in accordance with claim 30, wherein the complexed ionophoric polymer is poly(2-methyltetrahydrofuran 2,5 diyl).

46. A toner composition in accordance with claim 1 wherein the complexed ionophoric polymer is a (styrene/ethylene oxide)diblock polymer.

47. A toner composition in accordance with claim 1 wherein the complexed ionophoric polymer is a (styrene/2-methyltetrahydrofuran 2,5 diyl)diblock polymer.

48. A toner composition in accordance with claim 1 wherein the complexed ionophoric polymer is a (2-methyltetrahydrofuran).

49. A toner composition in accordance with claim 1 wherein the complexed ionophoric polymer is a poly(-tetrahydrofuran 2,5 diyl).

* * * * *